United States Patent [19]

Makinson

[11] Patent Number: 4,843,676

[45] Date of Patent: Jul. 4, 1989

[54] CLIP FOR INSTALLING CARPET FIXING STRIP

[76] Inventor: Edward Makinson, Rose Lea, Kneesall, Newark, Nottinghamshire NG220 AZ, Great Britain

[21] Appl. No.: 146,614

[22] Filed: Jan. 20, 1988

[30] Foreign Application Priority Data

Jan. 27, 1987 [GB] United Kingdom ..... 8701764

[51] Int. Cl.[4] ..... A47G 27/04

[52] U.S. Cl. ..... 16/4; 16/8

[58] Field of Search ..... 16/4, 7, 8, 16

[56] References Cited

U.S. PATENT DOCUMENTS 3,325,851 6/1967 Hill .
3,559,273 1/1969 Porzio .
3,805,862 4/1974 Jirovetz .

FOREIGN PATENT DOCUMENTS 358627 10/1931 United Kingdom .
835191 5/1960 United Kingdom .
846739 8/1960 United Kingdom ..... 16/8
1136230 12/1968 United Kingdom ..... 16/16
1195267 6/1970 United Kingdom .

*Primary Examiner*—Fred A. Silverberg
*Attorney, Agent, or Firm*—Varnum, Riddering, Schmidt & Howlett

[57] ABSTRACT

A clip for securing a carpet fixing strip relative to a floor, comprises a first part which, in use, engages over the fixing strip and constrains the strip against movement relative to the floor, a second part connected to the first part and, in use, extending towards, and engaging with, an adjacent upright surface, a third part also connected to the first part and in use extending generally away from the upright surface, the third part, in use, being connected to the floor, so that, the clip is held against movement away from the upright surface by virtue of the third part being connected to the floor, and the engagement between the second part of the clip and the upright surface holds the first part rigid so as to constrain the carpet fixing strip against lifting/rotational movement due to the tension applied to a carpet secured to the carpet fixing strip.

2 Claims, 1 Drawing Sheet

-F-

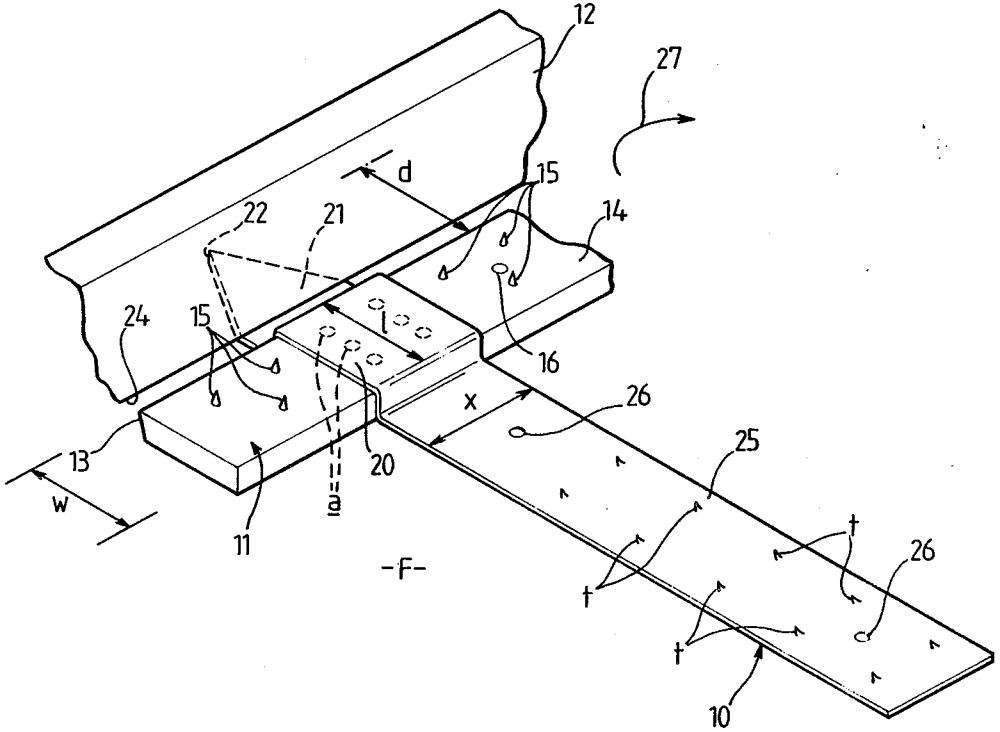
-F-

CLIP FOR INSTALLING CARPET FIXING STRIP

BACKGROUND OF THE INVENTION

This invention relates to a clip for securing, relative to a floor, a carpet fixing strip of the kind comprising an elongate member having a plurality of teeth extending from an, in use, upwardly facing surface, the teeth engaging with a carpet adjacent an edge of the carpet, to retain the carpet usually under tension.

Such carpet fixing strips are well kwown. Conventionally such strips are secured to a floor on which the carpet is laid by nails which pass through the strip into the floor.

Where the floor is wooden this presents no problem. Where the floor is a solid floor, the use of special nails has been necessary. However were the floor has a poor surface such nails are unable to provide an adequate fixing between the strip and the floor.

DESCRIPTION OF THE PRIOR ART

Various proposals have been put forward as a solution to this problem. For example, it has been proposed to bond the carpet fixing strips to the floor, but where the floor surface is poor when tension is applied to a carpet being fixed, this can simply cause the surface to disintegrate. Further, in order to achieve an adequate bond it is necessary to cut the carpet fixing strip into short lengths in order to accommodate uneven floors. This is inconvenient.

The use of threaded fasteners to secure the carpet fixing strips adjacent the edge of the floor, has proved unsatisfactory because the edge of the floor, which is usually the weakest position, can crack or otherwise be damaged on insertion of the fastener and/or the fasteners or a fixing plug for the fasteners can be pulled out when tension is applied to the carpet being fixed.

Clips have been proposed, but these need to be secured to an adjacent skirting board, wall or other upright surface by fasteners, which has proved difficult, time consuming and unsatisfactory or have not allowed the carpet fixing strip to lie flat on the floor.

OBJECT OF THE INVENTION

Accordingly it is an object of the present invention to provide a new or improved clip for securing carpet fixing strips relative to floors.

SUMMARY OF THE INVENTION

According to the invention I provide a clip for securing a carpet fixing strip relative to a floor, the clip comprising a first part which, in use, engages over the fixing strip so that the fixing strip is located between the first part and the floor in contact with the floor, the first part constraining the strip against movement relative to the floor, a second part, means connecting the second part to the first part, the second part, in use, extending towards, and engaging with, an adjacent upright surface, a third part, means connecting the third part to the first part, the third part in use, extending generally away from the upright surface, the third part being adapted to be connected to the floor.

Thus the clip is held against movement away from the upright surface by virtue of the third part being connected to the floor, and the engagement between the second part of the clip and the upright surface holds the first part rigid so as to constrain the carpet fixing strip against lifting/rotational movement due to the tension applied to a carpet secured to the carpet fixing strip.

The clip is preferably provided by a single metal form, the second and third parts being integrally formed with the first part although if desired, the second and/or third part may be attached to the first part.

Where the first, second and third parts are integrally formed, the clip may comprise a single sheet metal pressing although other methods of fabrication, and other materials may be employed as desired.

The cross section of the first part of the clip may correspond closely with the relatively transverse cross section of the carpet fixing strip with which the clip is to be used, so that for different widths of carpet fixing strip alternative types of of clips may be necessary.

The first part is preferably of a width such that the first part can be accommodated longitudinally of the strip between at least some of the teeth which extend upwardly from the upper surface of the strip, although alternatively the first part may have apertures through which the teeth may pass.

For the majority of carpet fixing strips, the first part may comprise an inverted generally U-shaped part receiving the carpet fixing strip in the U.

The second part may have a point at its end which may be driven into the upright surface which may be a skirting board or wall. This engagement with the skirting board or wall thus prevents the first part of the clip lifting which would occur as the carpet fixing strip tends to lift and rotate due to the carpet being under tension.

Preferably the point is spaced about 15 mm from the first part of the clip so that the clip may be driven through a standard thickness skirting board and into a wall behind, whilst leaving an ideal spacing between the carpet fixing strip and the upright surface for a carpet.

It will be appreciated that a spacing, or gully, of about two thirds of the carpet thickness is ideally required, and that carpet thickness vary between about 4.5 mm and 6.35 mm.

Of course, if a skirting board is spaced significantly above the floor, the second part may simply extend beneath the skirting board and may be driven into the wall behind rather than being driven through the skirting board and/or may be wedged beneath the skirting board, or where the upright surface is a wall provided with preformed openings to receive the second part, there would be no need to drive the second part into the upright surface. In both cases the second part will be prevented from lifting by the skirting board or wall, thus constraining the carpet fixing strip against rotation.

The third part may have at least one aperture to enable the first part to be connected to the floor, with a suitable fastener. Because the aperture can be spaced from the edge of the floor further than is possible when fasteners are used directly with the carpet fixing strips, the problem mentioned above associated with the edges of solid floors is relieved.

Further, because the fasteners which connect the third part to the floor do not have to hold the carpet fixing strips against rotation, which is achieved by the second part engaging the upright surface, the connection between the third part and the floor does not have to be as strong as where the fixing strips are secured to the floor by fasteners. The fastener simply needs to prevent the clip from moving away from the upright surface. Any alternative means for connecting the third part to the floor may be provided as required.

As mentioned above, the invention has been devised primarily for use with solid floors, i.e. screed, concrete or bitumous asphalt floors.

The invention can however be useful for use with wooden floors, where it is not easily possible to secure the carpet fixing strip adjacent the upright surface, for example beneath a wall mounted radiator. Because the connection between the third part of the clip and the floor is spaced further from the upright surface than the carpet fixing strip, fixing of the carpet fixing strip beneath a radiator is facilitated.

BRIEF DESCRIPTION OF THE DRAWING

The invention will now be described with reference to the accompanying drawing which is a diagrammatic illustration of part of a carpet fixing strip secured to a floor by a clip in accordance with the invention.

DESCRIPTION OF THE PREFERRED EMBODIMENTS

Referring to the drawing, a clip 10 is shown for securing a carpet fixing strip 11 to a floor F adjacent an upright surface comprising a skirting board 12 is shown. The carpet fixing strip is of generally rectangular cross section, but having a rebate 13 to receive the edge of the carpet which the carpet fixing strip is to retain.

Extending from an uppermost surface 14 of the strip 11, are a plurality of teeth 15 which are inclined towards the skirting board 12 and in use prevent the carpet moving away from the skirting board 12.

The carpet fixing strip shown is of the type which has openings 16 made by fasteners such as nails, to enable the strip 11 to be secured to the floor. However, such fasteners have been removed as the strip 11 is secured by the clip 10. However, fixing strips without such openings 16 may be used if required.

The clip 10 comprises a single sheet metal form e.g. a pressing, and has a first part 20 of generally inverted U-shaped configuration, the length dimension 1 of which follows very closely the width dimensions w of the carpet fixing strip 11. The strip 11 in use, lies flat between the first part 12 and the floor F.

Integrally formed with the first part 20 is a second part 21 which extends away from the first part 20 towards the skirting board 12. The second part 21 is provided with a point 22 which can be driven into the skirting board 12, and may extend through, into a wall behind, or may simply extend beneath the skirting board 12 depending on the spacing of a lower surface 24 of the skirting board 12 relative to the floor.

In the latter case, the second part 21 may be wedged beneath the skirting board 12.

Where the second part 21 is received beneath the skirting board 12, this need not be driven into the wall behind and thus need not have a point, but may be of an alternative configuration.

The clip comprises a third part 25 also formed integrally with the first part 20 and extending away from the skirting board 12.

The third part 25 is provided with, in the present case two, openings 26 which may receive fasteners to enable the third part 25 to be connected to the floor.

It will be appreciated that in use, when a carpet is retained by the carpet fixing strip 11, usually under tension, this tension will tend to cause the carpet fixing strip to rotate in the direction shown by the arrow 27. The first part 20 of the clip 10 constrains the carpet fixing strip against such movement by virtue of the second part 21 engaging with the skirting board 12. The clip 10 and hence carpet fixing strip 11 is prevented from moving away from the skirting board 12 by virtue of the third part 25 being connected to the floor by the fasteners which extend through the openings 26.

As shown, the distance between the point 22 and the first part 20, indicated at d, is about 15 mm. Preferably in use, the point 22 is driven through the skirting board 12, or extends below the skirting board 12 for a distance of about 12 mm so that the spacing or gully between the carpet fixing strip 11 and the skirting board 12 is about 3 mm, which is about the spacing ideally required for fitting of the carpet. For different thickness of carpet, different pulley sizes may be left.

It will be appreciated that a plurality of such clips 10 will be required along a length of carpet fixing strip 11, in order to provide adequate rigidity. However, the clip 10 may be used in conjunction with ordinary fasteners as required. The spacing of such clips may be chosen depending on the type and grade of carpet being fitted and/or the strength of connection which can be achieved between the third part 25 and the floor, and the strength of connection which can be achieved between the second part 21 and the skirting board 12.

Various modifications may be employed without departing from the scope of the invention.

For example, as shown the width x of the clip 10 is constant over its length and has been chosen so that the first part 20 can be received between at least some of the teeth 15 which extend from the upwardly facing surface 14 of the carpet fixing strip 11. For strips 11 in which the teeth have alternative spacings, the width dimension of at least the first part 20 may need to be changed. Alternatively, the first part 20 may be provided with apertures as shown in dotted lines at a through which the teeth 15 of the strip 11 may extend.

As described, the point 22 has been driven through or extends beneath a skirting board 12. Where no skirting board is provided, a suitable hardened point 22 may be driven into the masonry of a wall, or if desired, openings may be preformed in the wall to receive the second part 21 of the clip, which may thus be of other forms.

Although as described, fasteners have been used to connect the third part 25 to the floor, if desired, the third part may be connected to the floor by other means such as by bonding. Where fasteners are used, preferably, the type of fasteners is chosen so as to be ideally suited to the type of floor to which the third part 25 is connected.

If desired, the third part 25 of the clip 10 may have upwardly extending teeth as indicated at "t" to retain an underlay beneath the carpet which is fixed by the teeth 15.

I claim:

1. A one-piece metal clip for securing a carpet fixing strip relative to a floor, said carpet fixing strip having teeth adapted to grip a carpet under tension, the clip comprising:

a first part comprising an inverted generally U-shaped portion which, in use, engages over the fixing strip so that the fixing strip is located within the U-shaped portion between the first part and the floor and in contact with the floor, the first part constraining the strip against movement relative to the floor;

a second part integrally connected to the first part, and having a free end, said free end having means adapted for extending towards, and engaging with, an adjacent upright surface; and a third part integrally connected to the first part, the third part extending generally away from the upright surface for preventing rotation of the clip away from the upright surface when the clip engages the fixing strip and the fixing strip grips a carpet.

2. A clip according to claim 1 wherein the clip comprises a single sheet metal pressing.

* * * * *